US011685017B2

(12) United States Patent
Joyce et al.

(10) Patent No.: US 11,685,017 B2
(45) Date of Patent: Jun. 27, 2023

(54) STORAGE SHIELD FOR ANGLE GRINDING DISC

(71) Applicant: WEST BUFKIN IND., LLC, Mt. Vernon, IN (US)

(72) Inventors: Chris Joyce, Mt. Vernon, IN (US); Danny Banks, Mt. Vernon, IN (US)

(73) Assignee: West Bufkin Industries, LLC, Mt. Vernon, IN (US)

( * ) Notice: Subject to any disclaimer, the term of this patent is extended or adjusted under 35 U.S.C. 154(b) by 423 days.

(21) Appl. No.: 17/015,900

(22) Filed: Sep. 9, 2020

(65) Prior Publication Data

US 2021/0245327 A1 Aug. 12, 2021

Related U.S. Application Data

(60) Provisional application No. 62/971,300, filed on Feb. 7, 2020.

(51) Int. Cl.
*B24B 55/05* (2006.01)
*B24B 23/02* (2006.01)

(52) U.S. Cl.
CPC ..... *B24B 55/052* (2013.01); *B24B 23/028* (2013.01)

(58) Field of Classification Search
CPC ..... B24B 55/04; B24B 55/045; B24B 55/05; B24B 55/052; B24B 55/06; B24B 55/01;
(Continued)

(56) References Cited

U.S. PATENT DOCUMENTS 102,923 A * 5/1870 Disston ..... B23D 59/00 206/349
716,785 A * 12/1902 Taylor ..... B25H 3/003
(Continued)

FOREIGN PATENT DOCUMENTS

CN 107263325 A * 10/2017
DE 10308340 A1 * 9/2004 ..... B24B 23/02
(Continued)

*Primary Examiner* — Joel D Crandall
(74) *Attorney, Agent, or Firm* — C. Richard Martin; Martin IP Law Group

(57) ABSTRACT

A storage shield for a disc of an angle grinder is provided according to the present invention. The storage shield includes a first shield member and a second shield member. Each of the first and second shield members includes a front face, an opposing rear face positioned parallel to and a distance apart from the front face, an end wall that joins an upper edge of the front face to an upper edge of the rear face, and a front face opening between a lower edge of the front face and a lower edge of the rear face, and an opening in a center area of the front face at the lower edge thereof. A pivot hinge assembly pivotally connects a first end of the first shield member to a first end of the second shield member. Fastening means for affixing the storage shield and stored angle grinder to a worksite surface are affixed to the rear face of one of the first shield member or second shield member. A method of protecting a disc of an angle grinder when not in use is also provided. First, the storage shield is opened. Second, the disk of the angle grinder is inserted into the open storage shield such that a spindle of the angle grinder is aligned with the openings in the front faces of the first and second shield members. Next the storage shield is closed. Finally, the storage shield and the angle grinder are affixed to a worksite surface.

14 Claims, 7 Drawing Sheets

(58) Field of Classification Search
CPC ..... B24B 55/102; B24B 27/02; B24B 45/00; B24B 45/003; B24B 45/006; B25H 3/003; B25H 3/006; B27B 5/29; B27G 19/02; B27G 19/04; B65D 25/22; B65D 25/02; Y10T 409/30392; Y10T 83/606
See application file for complete search history.

(56) References Cited

U.S. PATENT DOCUMENTS

| | | | | |
|---|---|---|---|---|
| 2,471,561 | A * | 5/1949 | Fielding | B24B 55/04 29/DIG. 51 |
| 2,491,957 | A * | 12/1949 | Dilley | F16P 1/02 29/DIG. 95 |
| 2,598,192 | A * | 5/1952 | Poust | B65D 85/58 206/349 |
| 2,601,426 | A * | 6/1952 | Baumann | B65D 85/02 206/349 |
| 3,585,980 | A | 6/1971 | Mellor | |
| 3,701,369 | A | 10/1972 | Gronke et al. | |
| 3,711,949 | A | 1/1973 | Doyel | |
| 4,186,634 | A * | 2/1980 | Akczinski, Sr. | B26D 7/22 83/478 |
| 4,246,818 | A * | 1/1981 | McGraw, Jr. | B26D 7/225 83/DIG. 1 |
| 4,275,435 | A | 1/1981 | Dorn | |
| 4,791,541 | A | 12/1988 | Simmons | |
| 4,962,581 | A * | 10/1990 | Rutigliano | B26D 7/22 134/32 |
| 5,579,584 | A | 12/1996 | Hoffman | |
| 6,267,239 | B1 * | 7/2001 | Maki | B23D 59/00 206/349 |
| 6,425,682 | B1 | 7/2002 | Klaus | |
| 6,547,066 | B2 * | 4/2003 | Koch | G11B 33/0444 |
| 6,722,046 | B2 | 4/2004 | Evenson | |
| 6,729,468 | B1 * | 5/2004 | Dobmeier | B23D 59/00 206/349 |
| 7,178,214 | B1 * | 2/2007 | Wilson | B25B 9/00 29/281.1 |
| 8,460,070 | B2 | 6/2013 | Boeck et al. | |
| 8,746,451 | B2 * | 6/2014 | Nicholls | B25H 3/006 206/349 |
| 10,201,889 | B2 | 2/2019 | Morris et al. | |
| 10,307,886 | B2 | 6/2019 | Arthur et al. | |
| 10,357,868 | B2 | 7/2019 | Kawakami et al. | |
| 10,512,999 | B2 * | 12/2019 | Behringer | B27G 19/04 |
| 2003/0075028 | A1 | 4/2003 | Hofmann et al. | |
| 2010/0325903 | A1 | 12/2010 | Patel | |
| 2019/0202046 | A1 | 7/2019 | Shibata et al. | |
| 2019/0275664 | A1 * | 9/2019 | Pingitore | B25H 3/003 |
| 2020/0338689 | A1 * | 10/2020 | Alvarez | B24B 55/102 |

FOREIGN PATENT DOCUMENTS

| | | |
|---|---|---|
| GB | 2329440 | 3/1999 |
| WO | 2005072911 | 8/2005 |

* cited by examiner

STORAGE SHIELD FOR ANGLE GRINDING DISC

BACKGROUND OF THE INVENTION

Field of the Invention

The present invention relates to a device for protecting the blade of a tool from damage when not in use. More specifically, the present invention relates to a device for protecting the blade of an angle grinding disc from the elements and from damage when it is not in use.

Description of the Related Art

Angle grinders are a handheld power tool with an abrasive rotating wheel, often found on construction sites, used for cutting, grinding and polishing. Angle grinders offer a fast and effective way to cut and smooth a variety of surfaces and materials. But they can also be dangerous.

According to the U.S. Consumer Product Safety Commission, in 2008, nearly 25,000 people were injured in the United States while using angle grinders. The majority of these injuries occur from an abrasive blade shattering, diamond-blade segment loss, or the angle grinder kicking back. Any one of these scenarios is potentially fatal, with a high percentage of non-fatal injuries requiring hospitalization.

For safety sake, it is extremely important to ensure that the proper size disc is used and that the disc is free from defects and damage. When a disc rotating at a rate of 10,000 to 15,000 revolutions per minute is shattered, the pieces gain sufficient momentum to travel far as a missile and can cause significant damage or injury to objects or people in their path. One of the most common causes of disc burst is that the abrasive-disc has a crack, break or chip in its surface. Damage to the disc can easily occur if the angle grinder and disc are left laying out at a worksite where the disc is exposed to external hazards that could come into contact with the disc causing cracks, breaks or chips.

Accordingly, there is a need for a device that can be used at a worksite to protect the disc of an angle grinder from external hazards when the angle grinder is not in use.

SUMMARY OF THE INVENTION

It is therefore an object of the present invention to provide a device that shields a disc of an angle grinder from external hazards that may cause damage to the disc at a worksite.

It is also an object of the invention to provide a shielding device that can quickly and easily be placed around the disc for protection, and is capable of storing/locating the tool in a place where it is free from such hazards and readily available for use when needed.

The present invention meets these objects by providing a storage shield for an angle grinding disc that protects the disc from damage by external hazards when not in use.

According to one presently preferred embodiment of the invention, there is provided a storage shield for a disc of an angle grinder. The storage shield includes a first shield member having a front face, an opposing rear face positioned parallel to and a distance apart from the front face, an end wall that joins an upper edge of the front face to an upper edge of the rear face, and a front face opening between a lower edge of the front face and a lower edge of the rear face, and an opening in a center area of the front face at the lower edge thereof. A second shield member is also provided having a front face, an opposing rear face positioned parallel to and a distance apart from the front face, an end wall that joins an upper edge of the front face to an upper edge of the rear face, and a front face opening between a lower edge of the front face and a lower edge of the rear face, and an opening in a center area of the front face at the lower edge thereof. A pivot hinge assembly is provided and pivotally connects a first end of the first shield member to a first end of the second shield member. Finally, fastening means are provided for affixing the storage shield and stored angle grinder to a worksite surface. The fastening means may be affixed to the rear face of one of the first shield member or second shield member.

The first and shield members may be semicircular in shape such that when the storage shield is in a closed position with the lower edge of the first shield member in contact with the lower edge of the second shield member, the storage shield is circular in shape. The front face opening in each of the first and second shield members may similarly be semicircular in shape such that when the storage shield is in a closed position with the front face openings are circular and surround a spindle of the angle grinder. The fastening means may comprise a magnet, or a first magnet affixed to the rear face of the first shield member and a second magnet affixed to the rear face of the second shield member. The first and second shield members may be formed from a durable, rigid, impact resistant material such as thermoplastic.

According to another presently preferred embodiment of the invention, there is provided a method of protecting a disc of an angle grinder when not in use. First, the storage shield is opened. Second, the disk of the angle grinder is inserted into the open storage shield such that a spindle of the angle grinder is aligned with the openings in the front faces of the first and second shield members. Next the storage shield is closed. Finally, the storage shield and the angle grinder are affixed to a worksite surface.

The the step of opening the storage shield may comprise pivoting the first shield member in a direction away from the second shield member about the pivot hinge. The step of closing the storage shield may comprise pivoting the first shield member in a direction toward from the second shield member about the pivot hinge. The step of affixing the storage shield and the angle grinder to a worksite surface may comprise positioning a magnet on a rear surface of the rear surface of the storage shield in contact with a metal work surface.

These and other objects, features and advantages of the present invention will become apparent from a review of the following drawings and detailed description of the preferred embodiments of the invention.

BRIEF DESCRIPTION OF THE DRAWINGS

The present invention can best be understood in connection with the accompanying drawings. It is noted that the invention is not limited to the precise embodiments shown in the drawings, in which.

DETAILED DESCRIPTION OF THE INVENTION

Figure 1:
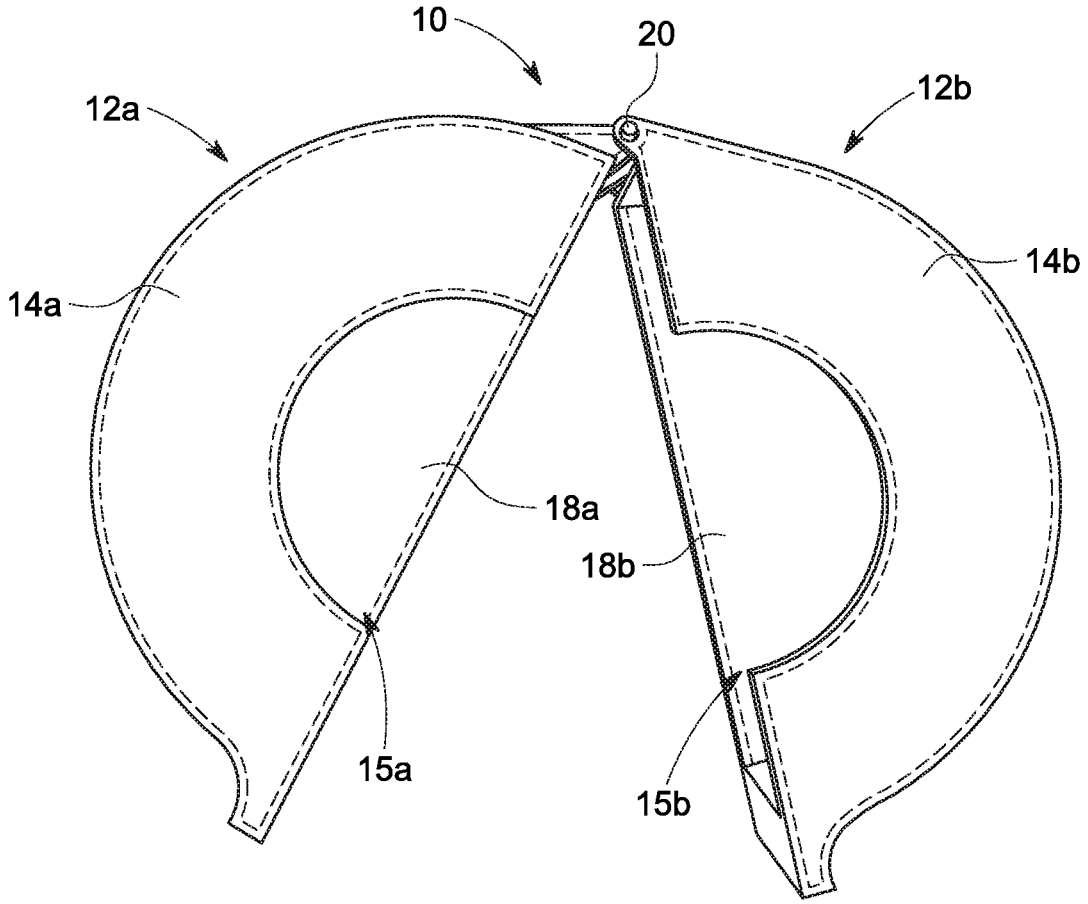
FIG. 1 is a front elevational view of a storage shield for an angle grinding disc according to a preferred embodiment of the invention.

For purposes of promoting and understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

Figure 5:
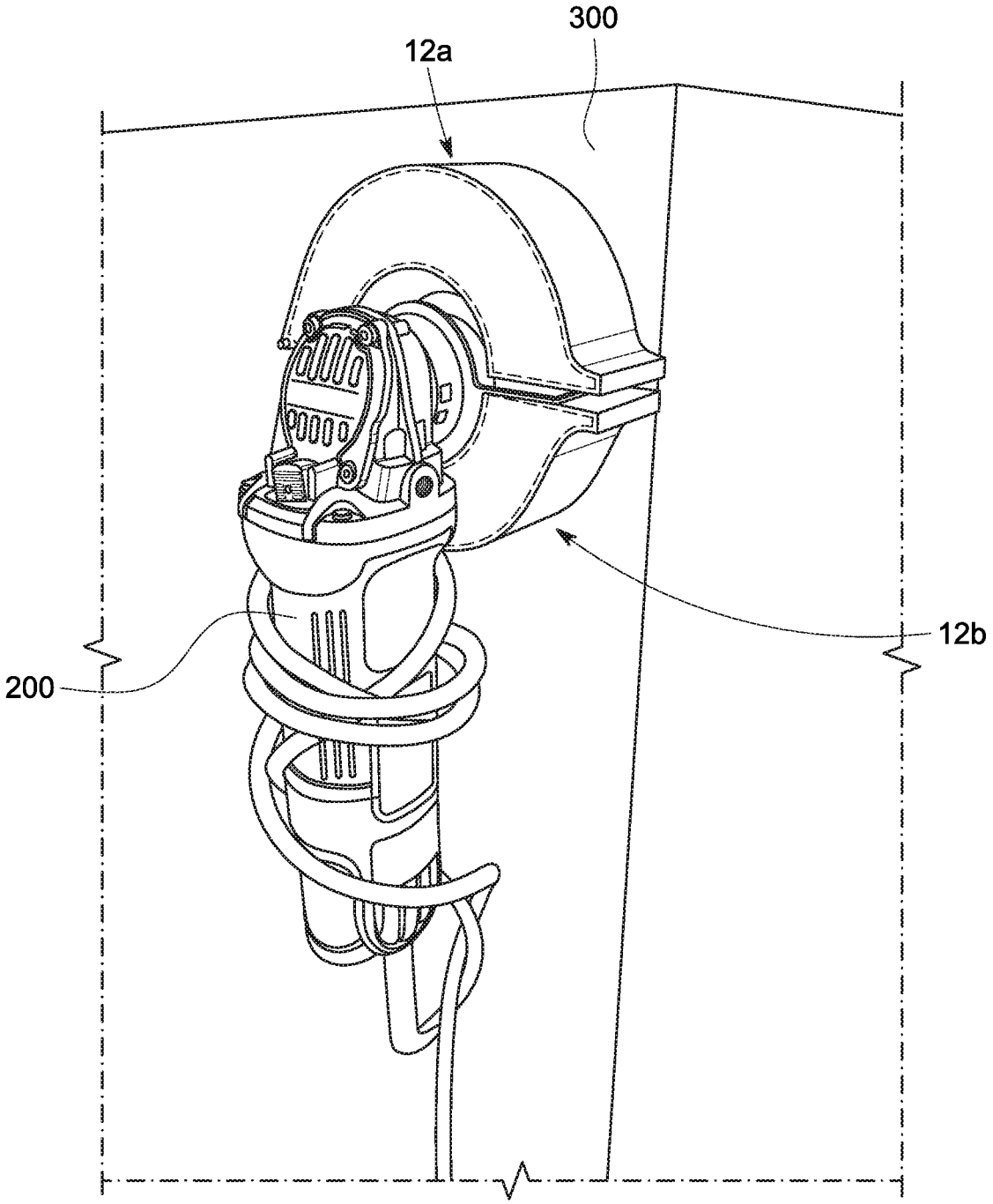
FIG. 5 is a perspective view of the storage shield shown in FIG. 1 in the closed position with the disc of an angle grinder disposed therein and with the storage shield mounted on a vertical surface.
Figure 6:
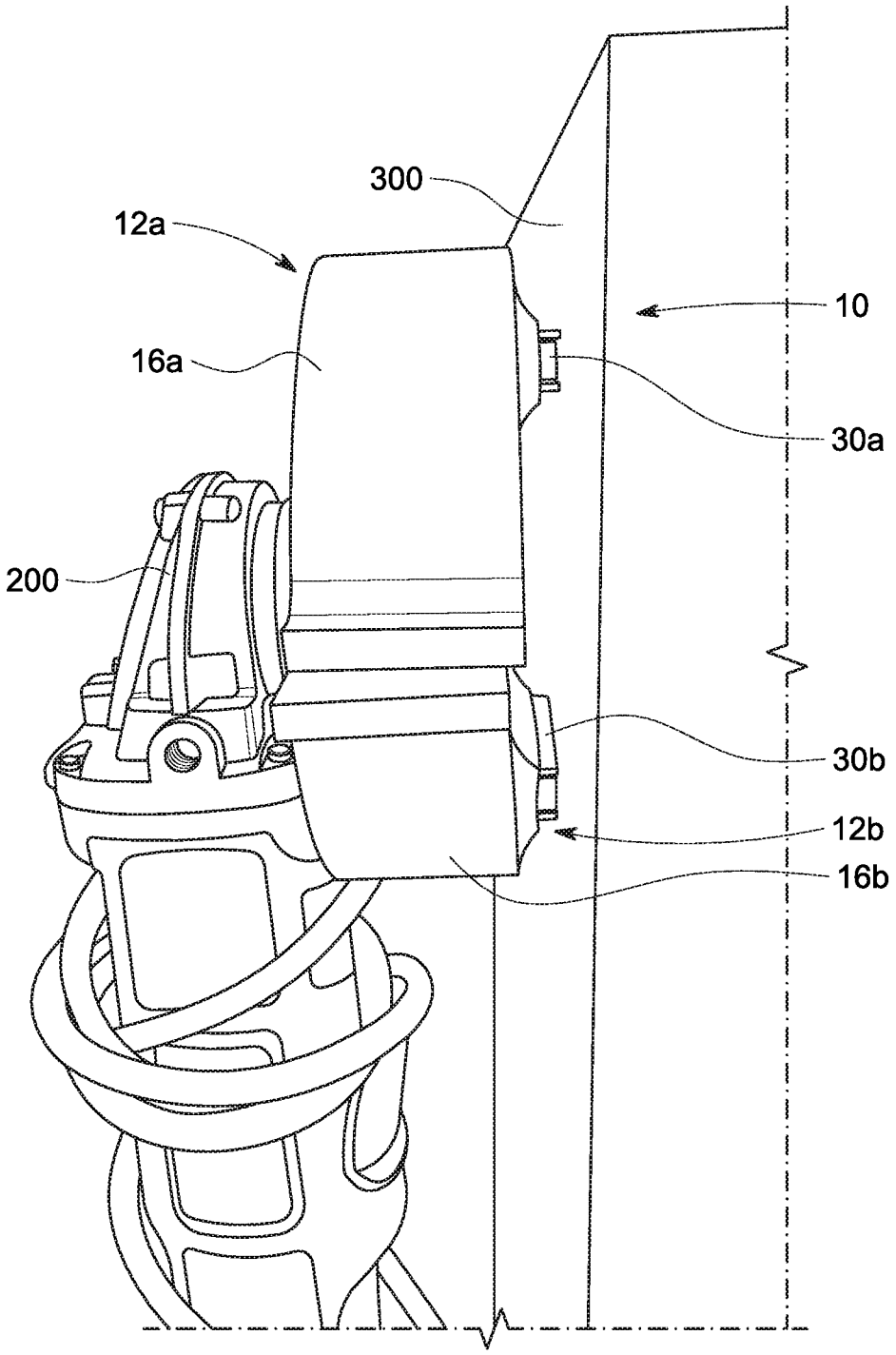
FIG. 6 is a side elevational view of the storage shield and angle grinder shown in FIG. 5.
Figure 7:
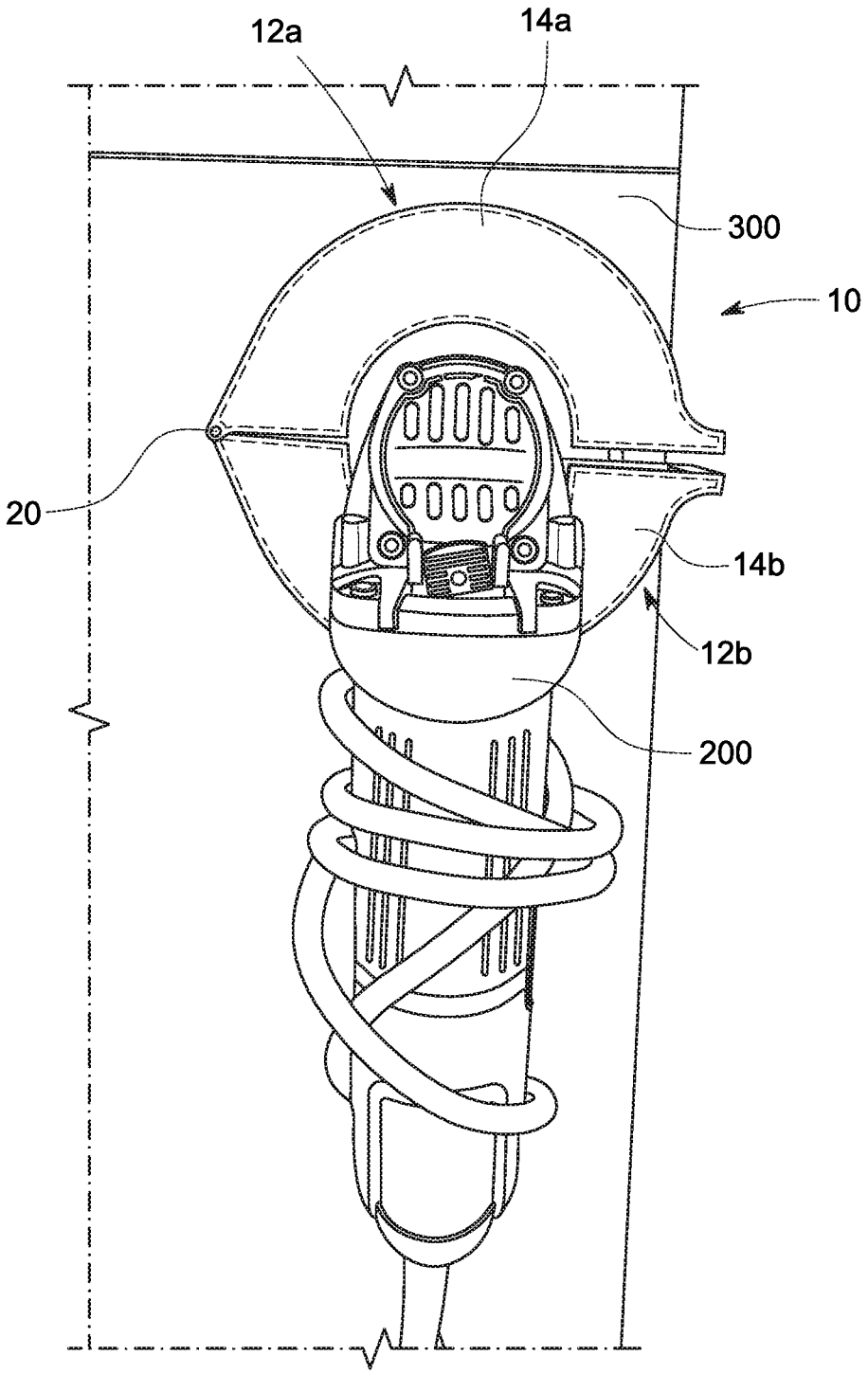
FIG. 7 is a front elevational view of the storage shield and angle grinder shown in FIG. 5.

One presently preferred embodiment of the invention comprises a storage shield 10 for a disc 100 of an angle grinder 200. As best shown in FIG. 1, the storage shield 10 includes two semi-circular or arc-shaped halves 12*a*, 12*b* that are essentially mirror images of one another. Each half 12*a*, 12*b* includes a front planar face 14*a*, 14*b* having a semi-circular or arc-shaped opening 15*a*, 15*b* at the lower edge thereof. The opening in the two halves 12*a*, 12*b* are shaped such that they substantially and completely surround the spindle of the angle grinder 200 when the storage shield is in the closed position as shown in FIG. 5-FIG. 7. The upper edge of the front planar face 14*a*, 14*b* is joined to an end wall 16*a*, 16*b*. According to the preferred embodiment shown in the drawings, the outer edge of each half 12*a*, 12*b* is semi-circular or arc-shaped at the point where it joins the end wall 16*a*, 16*b*, such that the shape of the storage shield 10, when assembled is circular like the disc 100 of the angle grinder 200. A rear planar face 18*a*, 18*b* is joined at its outer edge to the other opposing edge of the end wall 16*a*, 16*b*. The first end of the rear planar face 18*a*, 18*b* is straight and does not have an opening as in the front face 14*a*, 14*b*. In this manner, the disc is virtually completely enclosed within the storage shield 10 when it is in the closed position.

The two halves 12*a*, 12*b* of the storage shield 10 are joined together at first respective ends of the end walls 16*a*, 16*b* by a pivot hinge assembly 20, which allows the storage shield to be moved between a substantially open position as shown in FIG. 1, and a closed position as shown in FIG. 5-FIG. 7 surrounding the disc 100 of the angle grinder 200.

Figure 2:
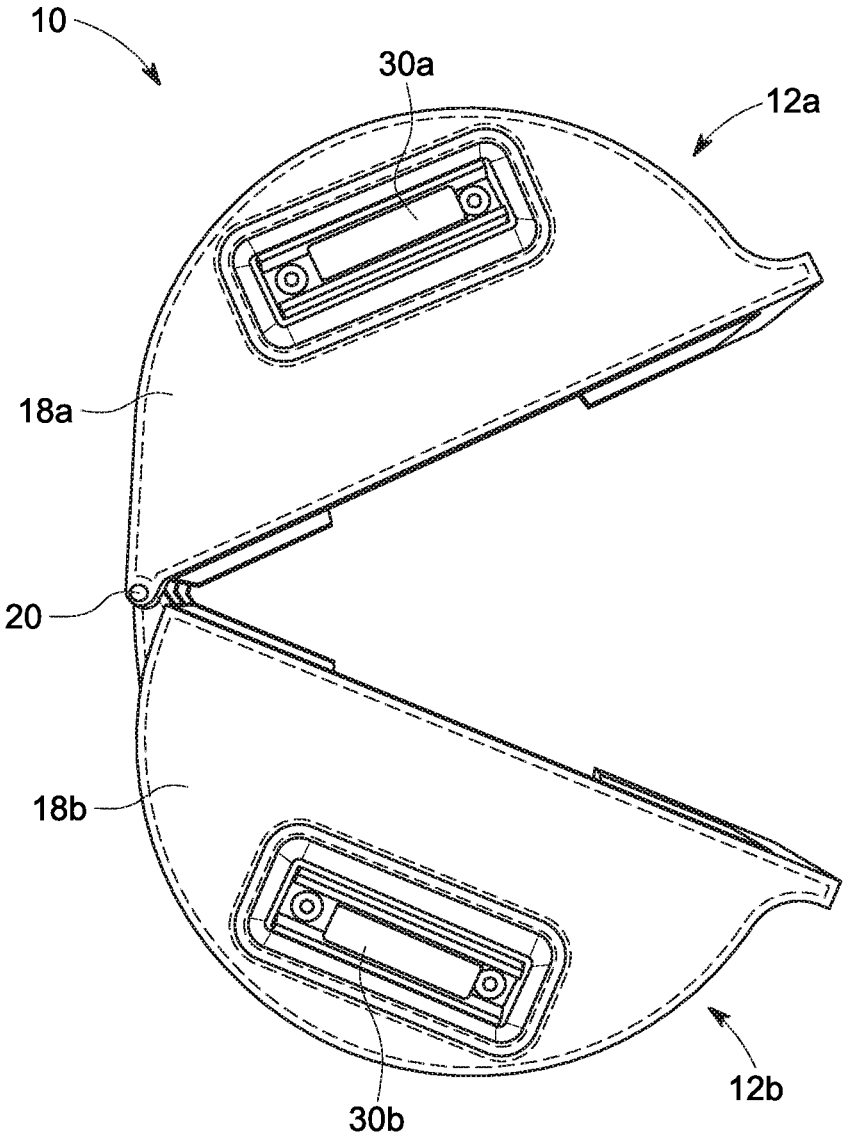
FIG. 2 is a rear elevational view of the storage shield shown in FIG. 1.
Figure 3:
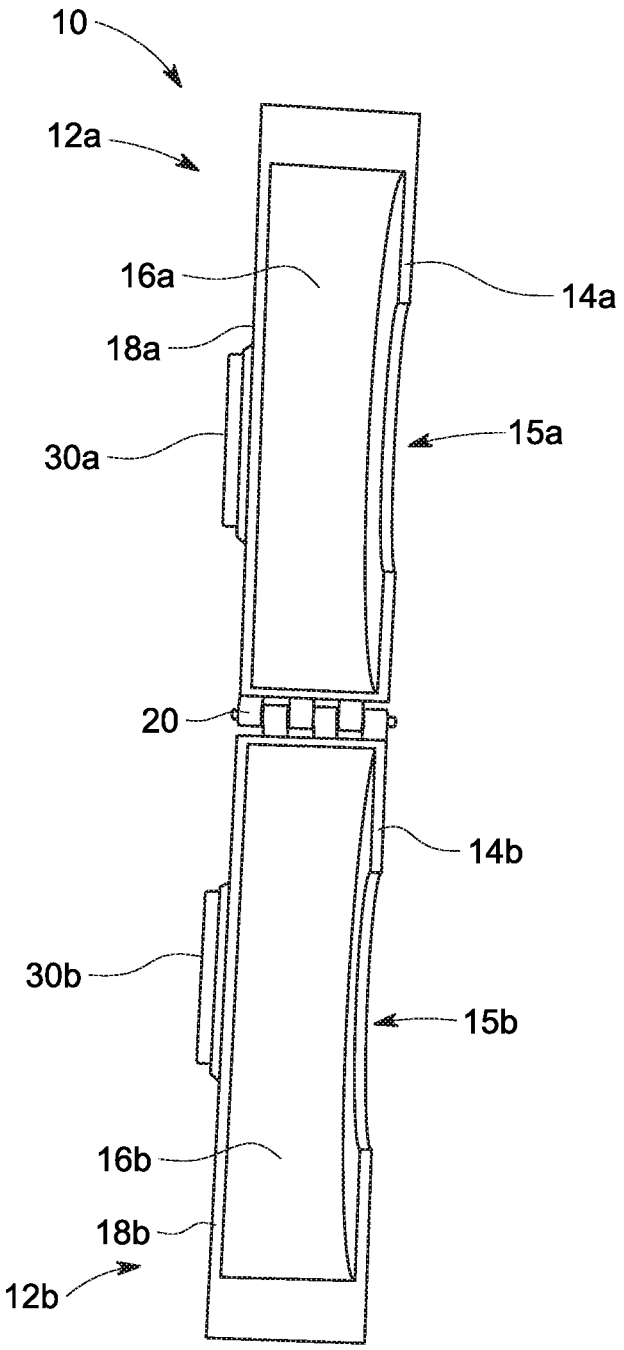
FIG. 3 is a side elevational view of the storage shield shown in FIG. 1.

As shown in FIG. 2, FIG. 3 and FIG. 6, the rear planar surface 18*a*, 18*b* of each half 12*a*, 12*b* of the storage shield 10 is provided with a magnet 30*a*, 30*b*, or other equivalent device for attaching the storage shield to a flat surface such as a vertical metal surface 300.

Figure 4:
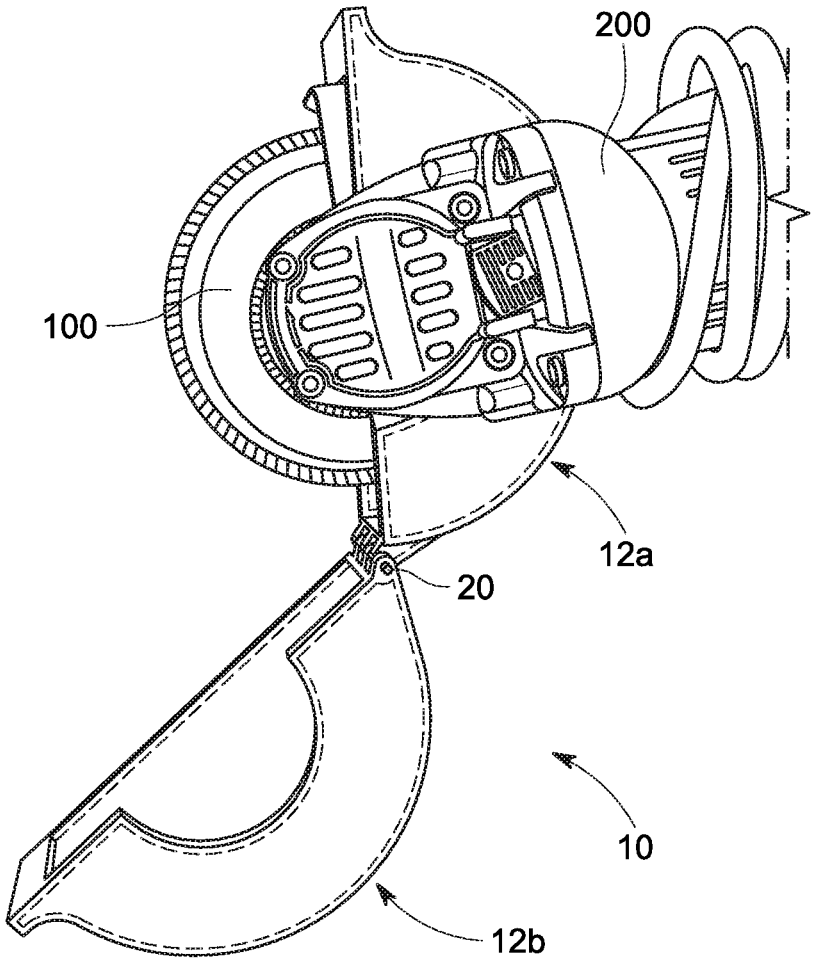
FIG. 4 is front elevational view of the storage shield shown in FIG. 1 in the open position with the disc of an angle grinder disposed therein.

In operation, the halves 12*a*, 12*b* of the storage shield 10 are pivoted around the hinge 20 to the open position as shown in FIG. 1, and the disc 100 of the angle grinder 200 is nested inside the first half 12*a* of the storage shield 10 such that the spindle of the grinder 200 rests upon the arc-shaped opening 15*a* as best shown in FIG. 4. The second half 12*b* of the storage shield 10 is then rotated about the hinge 20 to the closed position as shown in FIG. 5-FIG. 7 thereby completely surrounding the disc 100 protecting it from damage that could be caused by external hazards. The storage shield 10 with the disc 100 inside and angle grinder 200 attached, can then be affixed to a surface such as a metal wall or cabinet 300 for storage out of harms way.

While the outer shape of the storage shield 10 has been heretofore described as circular due to the circular shape of the disc 100, other shapes are contemplated. The primary issue or function of the storage shield is to completely surround and protect the disc 100 when the two halves of the storage shield 10 are closed, thereby preventing damage to the disc 100 from external sources. The two halves 12*a*, 12*b* of the storage shield may be formed of any suitable rigid material, and are preferably formed from a rigid and strong polymeric or thermoplastic that can withstand impacts that may be caused by external hazards. While magnets are described as being the preferred embodiment for attaching the storage shield 10 to a surface, any fastener or attachment system that allows such a device to be permanently or temporarily attached to a surface will suffice.

This detailed description, and particularly the specific details of the exemplary embodiment disclosed, is given primarily for clearness of understanding and no unnecessary limitations are to be understood therefrom, for modifications will become evident to those skilled in the art upon reading this disclosure and may be made without departing from the spirit or scope of the claimed invention.

We claim:

1. A storage shield for a disc of an angle grinder comprising:

a first shield member having a front face, an opposing rear face positioned parallel to and a distance apart from said front face, an end wall that joins an upper edge of the front face to an upper edge of the rear face, and an opening in a center area of the front face at the lower edge thereof;

a second shield member having a front face, an opposing rear face positioned parallel to and a distance apart from said front face, an end wall that joins an upper edge of the front face to an upper edge of the rear face, and an opening in a center area of the front face at the lower edge thereof;

a pivot hinge assembly pivotally connecting a first end of the first shield member to a first end of the second shield member, wherein the rear face of the first shield member and the rear face of the second shield member substantially cover the disc of the angle grinder when the storage shield is in a closed position; and fastening means for affixing the storage shield and stored angle grinder to a worksite surface, said fastening means affixed to the rear face of one of the first shield member or second shield member.

2. The storage shield according to claim 1 wherein the first and shield members are semicircular in shape such that when the storage shield is in a closed position with the lower edge of the first shield member in contact with the lower edge of the second shield member, the storage shield is circular in shape.

3. The storage shield according to claim 2 wherein the opening in the center area of the front face in each of the first and second shield members is semicircular in shape such that when the storage shield surrounds a spindle of the angle grinder is in a closed position the semicircular openings in the center area of the front face of the first and second members form a single circular opening.

4. The storage shield according to claim 1 wherein the opening in the center area of the front face in each of the first and second shield members is semicircular in shape such that when the storage shield surrounds a spindle of the angle grinder in a closed position the semicircular openings in the center area of the front face of the first and second members form a single circular opening.

5. The storage shield according to claim 1 wherein said fastening means comprises a magnet.

6. The storage shield according to claim 5 wherein said fastening means comprises a first magnet affixed to the rear face of the first shield member and a second magnet affixed to the rear face of the second shield member.

7. The storage shield according to claim 1 wherein the first and second shield members are formed from a thermoplastic material.

8. The storage shield according to claim 1, wherein an end wall of the rear face of the first shield member engages an end wall of the rear face of the second shield member when the storage shield is in the closed position such that the rear face of the first shield member and the rear face of the second shield member completely cover the disc of the angle grinder.

9. A method of protecting a disc of an angle grinder when not in use comprising the steps of:

opening a storage shield, said storage shield comprising a first shield member having a front face, an opposing rear face positioned parallel to and a distance apart from said front face, an end wall that joins an upper edge of the front face to an upper edge of the rear face, and an opening in a center area of the front face at the lower edge thereof; a second shield member having a front face, an opposing rear face positioned parallel to and a distance apart from said front face, an end wall that joins an upper edge of the front face to an upper edge of the rear face, and an opening in a center area of the front face at the lower edge thereof; and a pivot hinge assembly pivotally connecting a first end of the first shield member to a first end of the second shield member;

inserting the disk of the angle grinder into the open storage shield such that a spindle of the angle grinder is aligned with the openings in the front faces of the first and second shield members;

closing the storage shield; and affixing the storage shield and the angle grinder to a worksite surface.

10. The method of protecting a disc of an angle grinder according to claim 9, wherein the step of opening the storage shield comprises pivoting the first shield member in a direction away from the second shield member about the pivot hinge.

11. The method of protecting a disc of an angle grinder according to claim 10, wherein the step of closing the storage shield comprises pivoting the first shield member in a direction toward from the second shield member about the pivot hinge.

12. The method of protecting a disc of an angle grinder according to claim 9, wherein the step of closing the storage shield comprises pivoting the first shield member in a direction toward from the second shield member about the pivot hinge.

13. The method of protecting a disc of an angle grinder according to claim 9, wherein the step of affixing the storage shield and the angle grinder to a worksite surface comprises positioning a magnet on a rear surface of the rear surface of the storage shield in contact with a metal work surface.

14. The method of protecting a disc of an angle grinder according to claim 9, wherein an end wall of the rear face of the first shield member engages an end wall of the rear face of the second shield member when the storage shield is in a closed position such that the rear face of the first shield member and the rear face of the second shield member completely cover the disc of the angle grinder.

* * * * *